US008378952B2

(12) United States Patent
Kim

(10) Patent No.: US 8,378,952 B2
(45) Date of Patent: Feb. 19, 2013

(54) LIQUID CRYSTAL DISPLAY DEVICE WITH SHARED DATA LINES AND METHOD FOR PREVIOUSLY CHARGING GREEN PIXEL CELLS

(75) Inventor: Binn Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 983 days.

(21) Appl. No.: 11/966,839

(22) Filed: Dec. 28, 2007

(65) Prior Publication Data

US 2008/0266225 A1 Oct. 30, 2008

(30) Foreign Application Priority Data

Apr. 24, 2007 (KR) ..... 10-2007-0039681

(51) Int. Cl.
*G09G 3/36* (2006.01)

(52) U.S. Cl. ..... 345/100

(58) Field of Classification Search ..... 345/87–103; 324/770, 760.01–760.02; 349/192
See application file for complete search history.

(56) References Cited

U.S. PATENT DOCUMENTS 4,781,438 A * 11/1988 Noguchi ..... 349/54
5,081,687 A * 1/1992 Henley et al. ..... 382/141
5,151,689 A * 9/1992 Kabuto et al. ..... 345/103
6,552,707 B1 * 4/2003 Fujiyoshi ..... 345/98
6,707,441 B1 * 3/2004 Hebiguchi et al. ..... 345/92
2002/0070905 A1 * 6/2002 Kodate et al. ..... 345/55
2002/0149598 A1 * 10/2002 Greier et al. ..... 345/589
2005/0024316 A1 2/2005 Ohta et al.
2006/0081850 A1 * 4/2006 Lee et al. ..... 257/72
2007/0013643 A1 1/2007 Hong et al.
2008/0272710 A1 11/2008 Abe et al.

FOREIGN PATENT DOCUMENTS

JP 2003-295834 A 10/2003
JP 2007-25691 A 2/2007
KR 10-2006-0029369 A 4/2006
WO WO 2006/057187 A1 6/2006

* cited by examiner

*Primary Examiner* — Liliana Cerullo
(74) *Attorney, Agent, or Firm* — Birch, Stewart, Kolasch & Birch, LLP

(57) ABSTRACT

A liquid crystal display device and a method of driving the same are discussed. The liquid crystal display device according to an embodiment comprises a liquid crystal panel including a plurality of pixel units arranged in a matrix configuration; red, green and blue pixel cells provided in the pixel units respectively; a data driver to supply data to pixel cells included in each pixel unit, so as to realize the adjacent pixel units displayed with black and white; and a gate driver to drive the pixel cells included in each pixel unit, so as to make the green pixel cell in the pixel unit of displaying the white supplied with corresponding data under condition of that a data line connected to the corresponding green pixel cell is previously charged with the data corresponding to the pixel cell included in the pixel unit of displaying the black.

4 Claims, 6 Drawing Sheets

LIQUID CRYSTAL DISPLAY DEVICE WITH SHARED DATA LINES AND METHOD FOR PREVIOUSLY CHARGING GREEN PIXEL CELLS

This application claims the priority benefit of Korean Patent Application No. 10-2007-0039681 filed Apr. 24, 2007, which is hereby incorporated by reference as if fully set forth herein.

BACKGROUND OF THE INVENTION

1. Field of the Invention

The present invention relates to a liquid crystal display device, and more particularly, to a liquid crystal display device to prevent deterioration of picture quality in a super pixel gray pattern, and a method of driving the same.

2. Discussion of the Related Art

A liquid crystal display device displays images by controlling light transmittance in liquid crystal cells according to a video signal. Especially, an active-matrix type liquid crystal display device is advantageous to displaying moving pictures since a switching unit is provided in each of pixel cells. In this case, the switching unit is generally formed of a thin film transistor TFT.

The liquid crystal display device requires a picture test process to check a picture quality on a liquid crystal panel.

FIG. 1 is a diagram illustrating a super pixel gray pattern.

In order to perform a picture test process, as shown in FIG. 1, it necessarily requires a process of displaying a super pixel gray pattern on a screen of a liquid crystal panel 100. The super pixel gray pattern is similar to a mosaic pattern, wherein adjacent pixel units PXL are displayed with black and white. In FIG. 1, the pixel unit PXL for displaying the black is represented with slanted lines. The picture test process of the liquid crystal display device is performed by checking the screen in state of displaying the super pixel gray pattern.

The pixel unit PXL is comprised of red (R), green (G), and blue (B) pixel cells, among which green pixel cell G has the greatest visibility. In other words, the image displayed with the green pixel cell G is most visible. Accordingly, in order to prevent the inferiority of picture quality in the super pixel gray pattern, it is more important to uniformly maintain the luminance among the green pixel cells G than among the red pixel cells R, and among the blue pixel cells B.

To display the super pixel gray pattern on the screen, data corresponding to the super pixel gray pattern is supplied to data lines connected to the pixel cells. For the maintenance of uniform luminance among the green pixel cells G, the charging condition on the data line is identically applied to the green pixel cells G when the green pixel cells G are supplied with the data.

However, since the green pixel cells G are supplied with the data under the variable charging conditions, the difference of luminance occurs among the green pixel cells C, thereby causing the inferiority of picture quality in the super pixel gray pattern.

SUMMARY OF THE INVENTION

Accordingly, the present invention is directed to a liquid crystal display device and a method of driving the same that substantially obviates one or more problems due to limitations and disadvantages of the related art.

An object of the present invention is to provide a liquid crystal display device which prevents inferiority of picture quality in a super pixel gray pattern by supplying data to green pixel cells under the same charging condition, and a method of driving the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display device according to an embodiment comprises a liquid crystal panel including a plurality of pixel units arranged in a matrix configuration; red, green and blue pixel cells provided in the pixel units respectively; a data driver to supply data to pixel cells included in each pixel unit, so as to realize the adjacent pixel units displayed with black and white; and a gate driver to drive the pixel cells included in each pixel unit, so as to make the green pixel cell in the pixel unit of displaying the white supplied with corresponding data under condition of that a data line connected to the corresponding green pixel cell is previously charged with the data corresponding to the pixel cell included in the pixel unit of displaying the black.

In another aspect of the present invention, a method of driving a liquid crystal display device provided with a liquid crystal panel including a plurality of pixel units arranged in a matrix configuration, and red, green and blue pixel cells provided in the pixel units respectively, comprises supplying data to the pixel cells included in each pixel unit, so as to realize the adjacent pixel units displayed with black and white; and driving the pixel cells included in each pixel unit, so as to make the green pixel cell in the pixel unit of displaying the white supplied with corresponding data under condition of that a data line connected to the corresponding green pixel cell is previously charged with the data corresponding to the pixel cell included in the pixel unit of displaying the black.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a liquid crystal display device according to the present invention and a method of driving the same will be explained with reference to the accompanying drawings.

Figure 1:
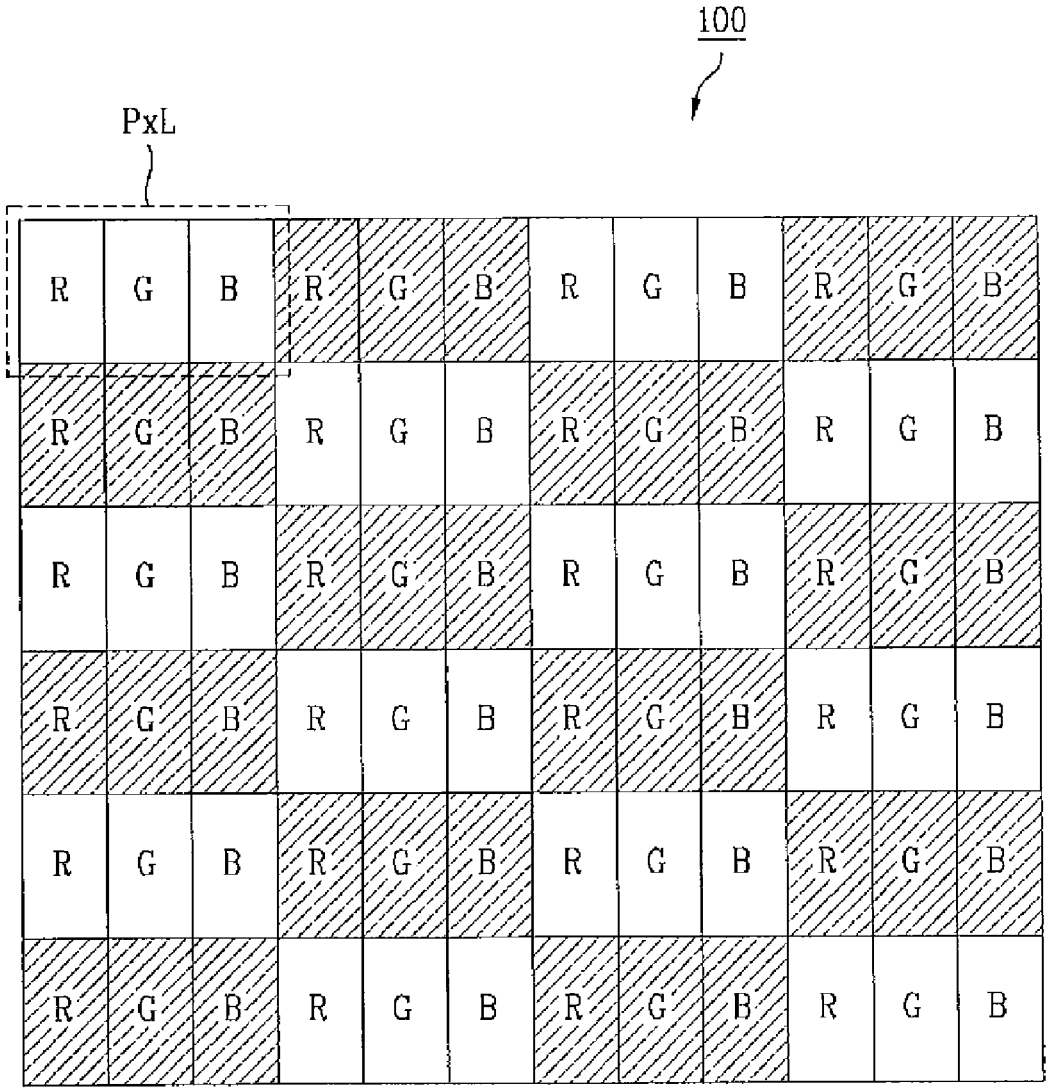
FIG. 1 Related Art
FIG. 1 is a diagram illustrating a super pixel gray pattern.
Figure 2:
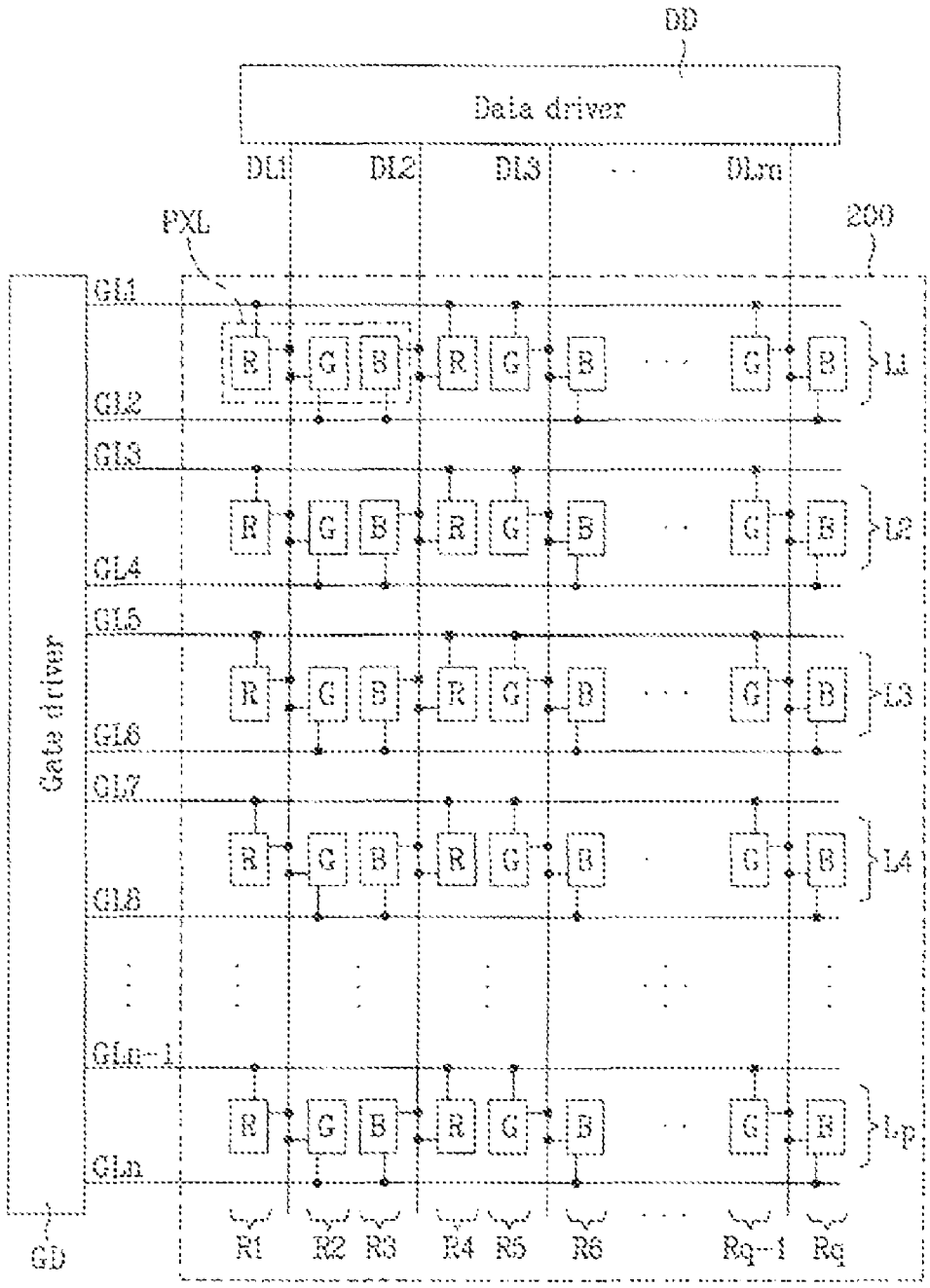
FIG. 2 is a diagram illustrating a liquid crystal display device according to a preferred embodiment of the present invention.

FIG. 2 is a diagram illustrating a liquid crystal display device according to a preferred embodiment of the present invention. As shown in FIG. 2, the liquid crystal display device according to the preferred embodiment of the present invention includes a liquid crystal panel 200 provided with a plurality of pixel cells R, G and B to display images; and a gate driver GD and a data driver DD to drive the liquid crystal panel 200.

At this time, the liquid crystal panel 200 includes a plurality of gate lines GL1 to GLn and a plurality of data lines DL1 to DLm, wherein each gate line GL is orthogonal to each data line DL. The gate driver GD outputs a scan pulse to drive the gate lines GL1 to GLn; and the data driver DD supplies data to the data lines DL1 to DLm. The data driver DD is supplied with the data for one line (data supplied to the pixel cells included in one pixel row) from a timing controller every horizontal period, and selects a gray scale voltage previously set according to the data for one line. Then, the gray scale voltages for the selected one line are supplied to the data lines, respectively.

For convenience of the explanation, the gray scale voltages supplied to the data lines DL1 to DLm are referred to as the data.

The gate lines GL1 to GLn are positioned at the upper and lower sides for each pixel row L1 to Lp. Also, the data lines DL1 to DLm are positioned in perpendicular to the pixel rows L1 to Lp, and the pixel cells are connected to both sides of each data line DL1 to DLm.

Among the pixel cells included in one pixel row, some of the pixel cells are connected to the gate line positioned at the upper side thereof in common, and the others are connected to the gate line positioned at the lower side thereof in common. For example, among the pixel cells included in the first pixel row L1, the '12c+1'th pixel cell ("c" is a positive whole number including '0'), the '12c+4'th pixel cell, the '12c+5'th pixel cell, the '12c+8'th pixel cell, the '12c+9'th pixel cell and the '12c+12'th pixel cell are connected to the first gate line GL1 in common; and the '12c+2'th pixel cell, the '12c+3'th pixel cell, the '12c+6'th pixel cell, the '12c+7'th pixel cell, the '12c+10'th pixel cell and the '12c+1'th pixel cell are connected to the second gate line GL2 in common.

Each pixel column R1 to Rq is provided with the pixel cells to display the same color. In more detail, the '3k+1'th pixel column ('k' is a positive whole number including '0') includes the red pixel cells R to display the red color; the '3k+2'th pixel column includes the green pixel cells G to display the green color; and the '3k+3'th pixel column includes the blue pixel cells B to display the blue color.

Although not shown, one pixel cell is comprised of a thin film transistor TFT which switches the data from the data line in response to the scan pulse from the gate line; a pixel electrode which is supplied with the data from the thin film transistor TFT; a common electrode which is positioned in opposite to the pixel electrode; and a liquid crystal layer which is positioned between the pixel electrode and the common electrode to control light transmittance according to an electric field therebetween.

The adjacent pixel cells included in the same pixel row are supplied with the data having the different polarities, and display the images. For example, in case of the red R and green C pixel cells included in the first pixel row L1 and connected to the both sides of the first data line DL1, the red pixel cell R shows the positive polarity and the green pixel cell G shows the negative polarity.

The adjacent pixel cells included in the same pixel column are supplied with the data having the different polarities every two pixel cells, to thereby display the images. For example, the red pixel cell R included in the first pixel column R1 and connected to the first gate line GL1 shows the positive polarity, and the red pixel cell R included in the first pixel column R1 and connected to the third gate line GL3 shows the positive polarity. Also, the red pixel cell included in the first pixel column R1 and connected to the fifth gate line GL5 shows the negative polarity, and the red pixel cell R included in the first pixel column R1 and connected to the seventh gate line GL7 shows the negative polarity. For this, the data driver DD alternately supplies the positive polarity data and the negative polarity data to the data lines DL1 to DLm every several periods, whereby the adjacent data lines are supplied with the data having the different polarities. That is, the data driver DD outputs the data by 4-dot inversion mode.

The adjacent three pixel cells (red R, green G and blue B pixel cells) included in the same pixel row constitute one pixel unit PXL. This pixel unit PXL displays one unit image by mixing the red image from the red pixel cell R, the green image from the green pixel cell G, and the blue image from the blue pixel cell B.

Figure 3:
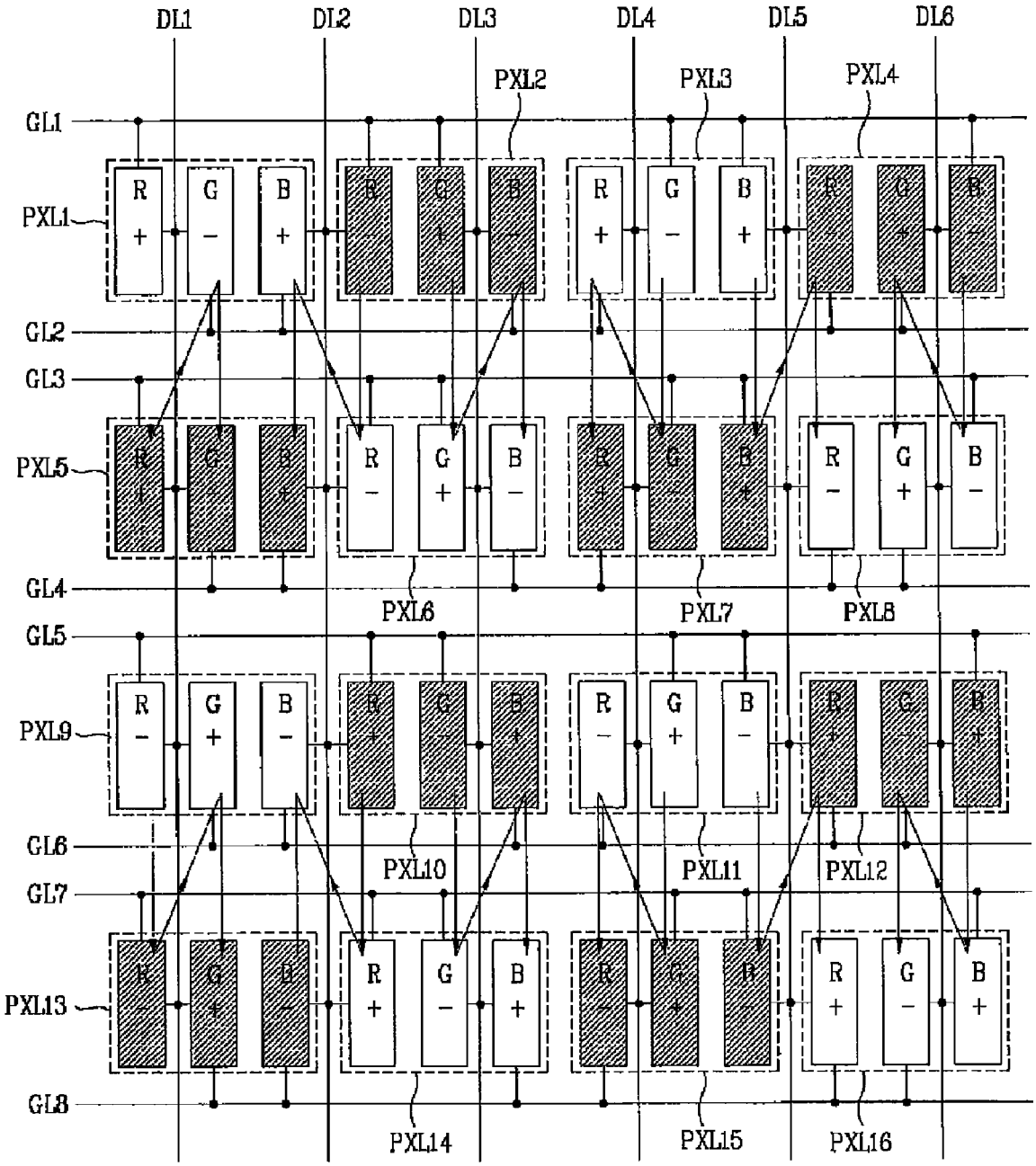
FIG. 3 is a diagram illustrating an order of driving first to seventh unit pixels of FIG. 2.
Figure 4:
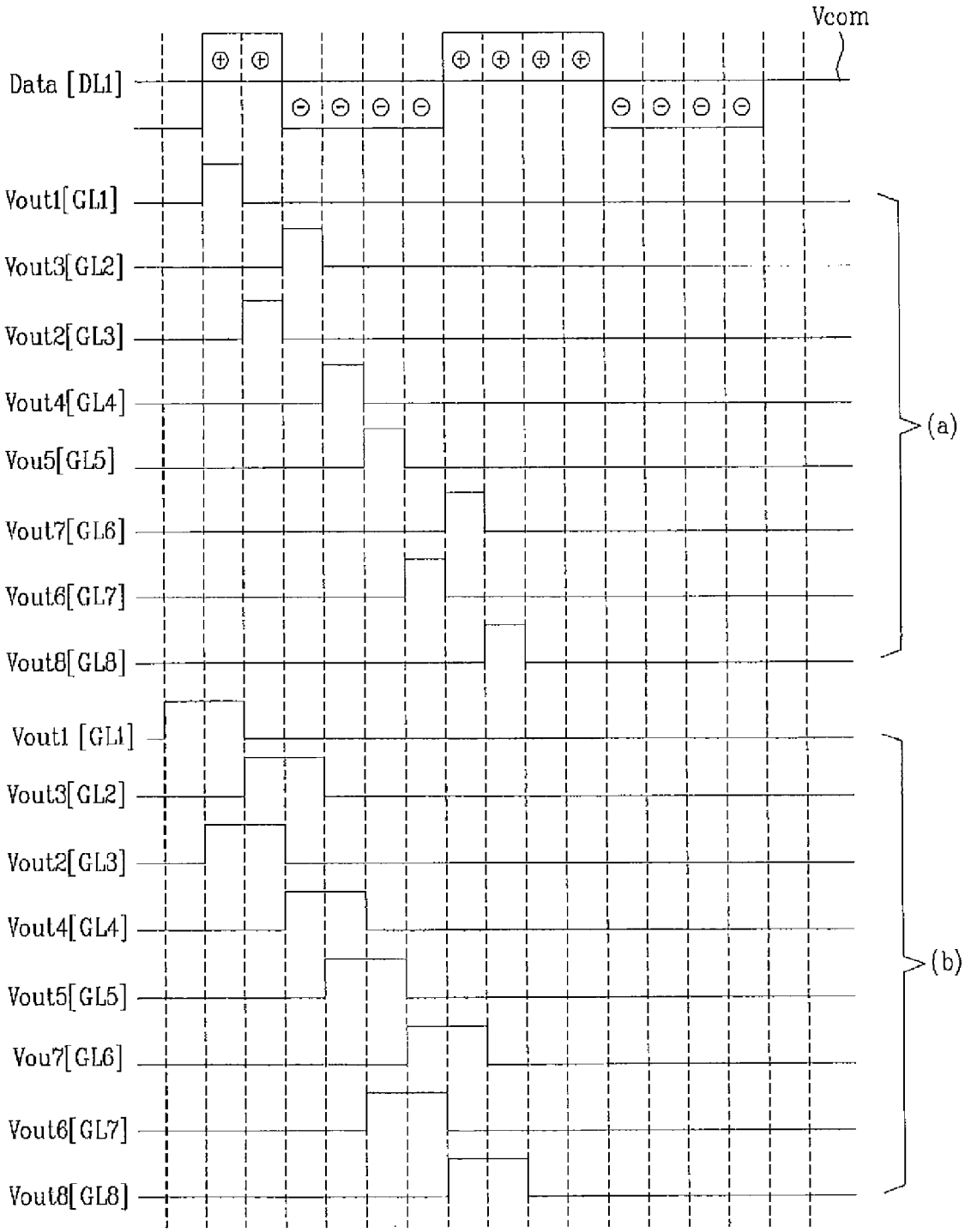
FIG. 4 is a waveform diagram illustrating various signals supplied to gate and data lines of FIG. 3.

A method of driving the liquid crystal display device to display the super pixel gray pattern on the screen of the liquid crystal panel 200 according to a preferred embodiment of the present invention will be explained with reference to the accompanying drawings. FIG. 3 is a diagram illustrating an order of driving first to seventh unit pixels of FIG. 2. FIG. 4 is a waveform diagram illustrating various signals supplied to gate and data lines of FIG. 3.

As shown in FIG. 3, the liquid crystal display device according to a preferred embodiment of the present invention includes a plurality of display units comprised of 48 pixel cells arranged in a matrix configuration of 12*4, wherein the 48 pixel cells constitute the first to sixteenth pixel units.

The images displayed in the first, third, sixth, eighth, ninth, eleventh, fourteenth and sixteenth pixel units are different from the images displayed in the second, fourth, fifth, seventh, tenth, twelfth, thirteenth and fifteenth pixel units. For example, the first, third, sixth, eighth, ninth, eleventh, fourteenth and sixteenth pixel units display the white; and the second, fourth, fifth, seventh, tenth, twelfth, thirteenth and fifteenth pixel units display the black.

An order of driving the pixel cells connected to the data lines DL1 to DLm is explained as follows.

Among the four pixel cells included in the adjacent two pixel rows and connected to the odd-numbered data line in common, the pixel cell included in the upper pixel row and positioned at the left side of the odd-numbered data line is driven firstly; the pixel cell included in the lower pixel row and positioned at the left side of the odd-numbered data line is driven secondly; the pixel cell included in the upper pixel row and positioned at the right side of the odd-numbered data line is driven thirdly; and the pixel cell included in the lower pixel row and positioned at the right side of the odd-numbered data line is driven finally.

For example, the red and green pixel cells R1. C included in the first pixel unit PXL1, and the red and green pixel cells R, G included in the fifth pixel unit PXL5 are connected to the first data line DL1 in common. Among the above-mentioned four pixel cells, the red pixel cell R included in the first pixel unit PXL1 is driven firstly; the red pixel cell R included in the fifth pixel unit PXL5 is driven secondly; the green pixel cell C included in the first pixel unit PXL1 is driven thirdly; and the green pixel cell C included in the fifth pixel unit PXL5 is driven finally.

Among the four pixel cells included in the adjacent two pixel rows and connected to the even-numbered data line in common, the pixel cell included in the upper pixel row and positioned at the right side of the even-numbered data line is driven firstly; the pixel cell included in the lower pixel row and positioned at the right side of the even-numbered data line is driven secondly; the pixel cell included in the upper pixel row and positioned at the left side of the even-numbered data line is driven thirdly; and the pixel cell included in the lower pixel row and positioned at the left side of the even-numbered data line is driven finally.

For example, the red and green pixel cells R, G included in the third pixel unit, and the red and green pixel cells R, G included in the seventh pixel unit PXL7 are connected to the fourth data line DL4 in common. Among the above-mentioned four pixel cells, the green pixel cell G included in the third pixel PXL3 unit is driven firstly; the green pixel cell G included in the seventh pixel unit PXL7 is driven secondly; the red pixel cell R included in the third pixel unit PXL3 is driven thirdly; and the red pixel cell R included in the seventh pixel unit PXL7 is driven finally.

Accordingly, the green pixel cell G included in the pixel unit of displaying the white is driven after the red pixel cell R included in the pixel unit of displaying the black. In other words, the green pixel cell G included in the pixel unit of displaying the white is supplied with the data from the data line for a predetermined period after a period of supplying the data to the red pixel cell R included in the pixel unit of displaying the black. For example, the green pixel cell G G1 included in the first pixel unit PXL1 of displaying the white is driven after driving the red pixel cell R included in the fifth pixel unit PXL5 of displaying the black. In other words, the green pixel cell G included in the first pixel unit PXL1 is supplied with the data from the first data line DL1 for the predetermined period after the period of supplying the data to the red pixel cell R included in the fifth pixel unit PXL5.

The gate lines GL1 to GL8 are driven in sequence by the scan pulses Vout1 to Vout8 from the gate driver GD.

Among the '8a+1'th gate line to the '8a+8'th gate line, they are driven in a sequential order from the '8a+1'th gate line, the '8a+3'th gate line, the '8a+2'th gate line, the '8a+4'th gate line, the '8a+5'th gate line, the '8a+7'th gate line, the '8a+6'th gate line, and the '8a+8'th gate line. For example, among the first to eighth gate lines GL1 to GL8, they are driven in a sequential order from the first gate line GL1, the third gate line GL3, the second gate line GL2, the fourth gate line GL4, the fifth gate line GL5, the seventh gate line GL7, the sixth gate line GL6, and the eighth gate line GL8.

As shown in (a) of FIG. 4, the scan pulses Vout1 to Vout8 may be output in sequence. Also, as shown in FIG. (b) of FIG. 4, the scan pulses Vout1 to Vout8 may be overlapped at their high periods, and outputted with the overlapped periods.

In the liquid crystal display device having the structure of FIG. 3, the polarity of data signal supplied to one data line is inverted every four periods.

Figure 5:
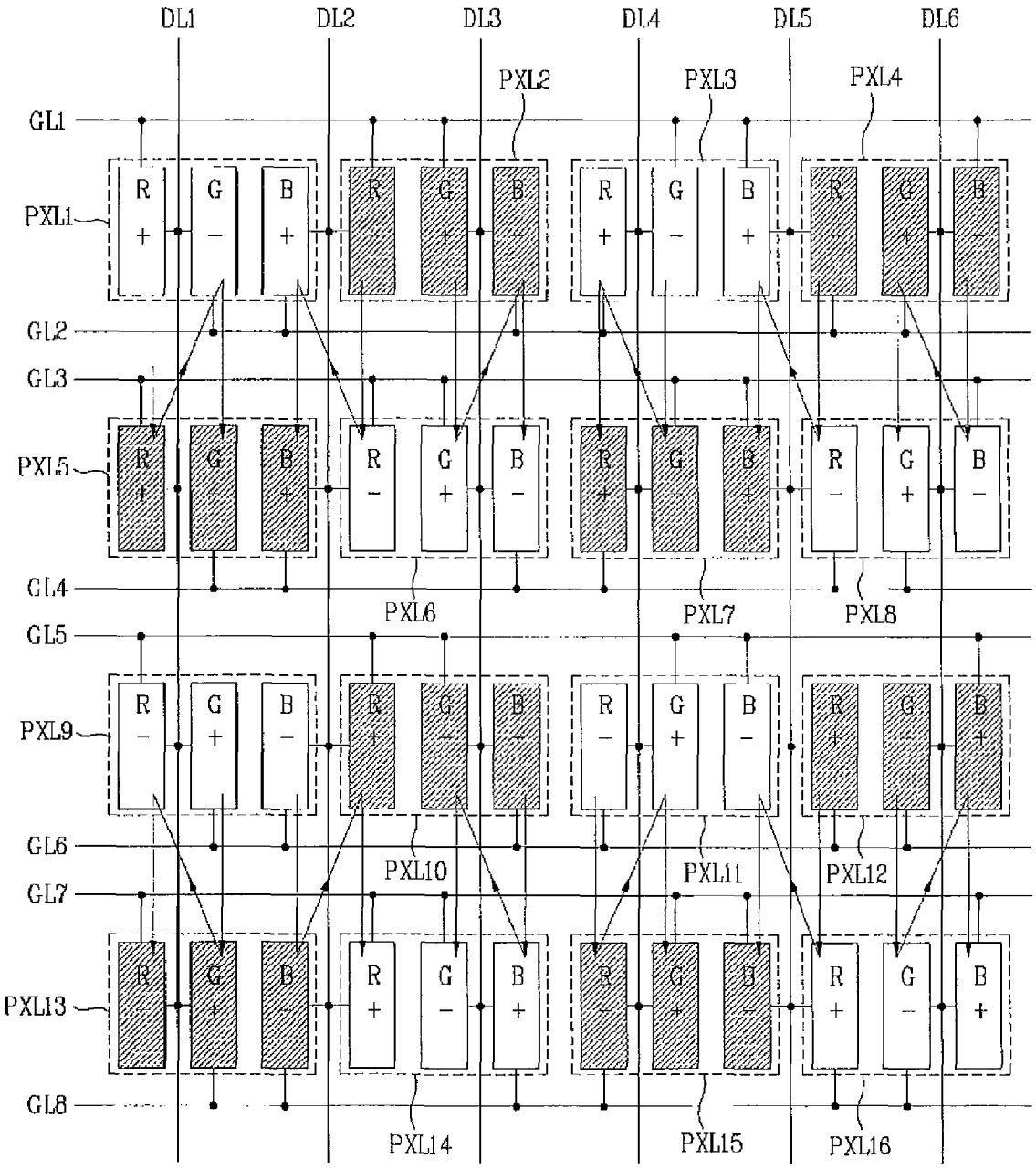
FIG. 5 is a diagram illustrating an order of driving first to eighth unit pixels of FIG. 2.
Figure 6:
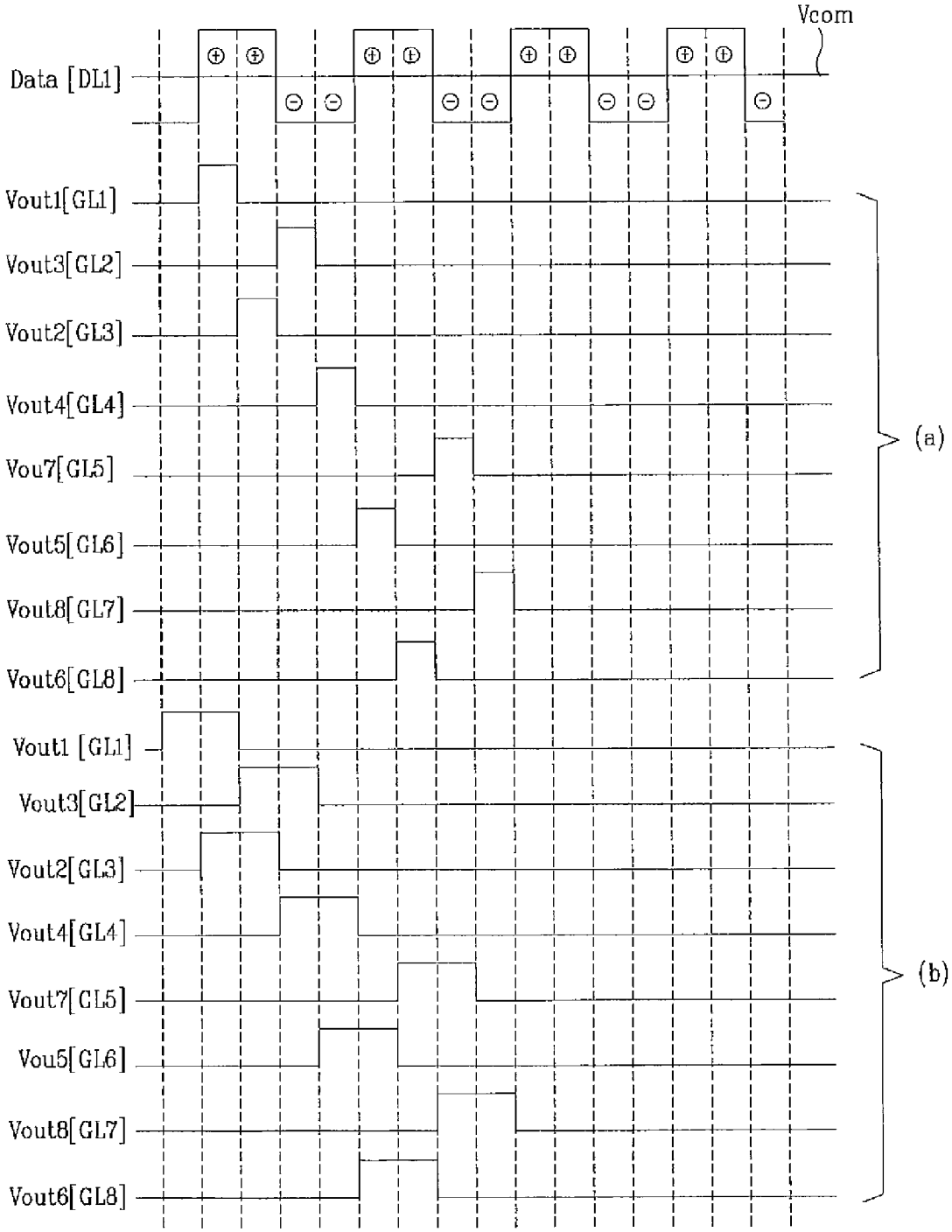
FIG. 6 is a waveform diagram illustrating various signals supplied to gate and data lines of FIG. 5.

FIG. 5 is a diagram illustrating an order of driving first to eighth unit pixels of FIG. 2. FIG. 6 is a waveform diagram illustrating various signals supplied to gate and data lines of FIG. 5.

As shown in FIG. 5, the liquid crystal display device according to a preferred embodiment of the present invention includes the plurality of display units comprised of the 48 pixel cells R, G and B arranged in the matrix configuration of 12*4, wherein the 48 pixel cells constitute the first to sixteenth pixel units PXL1 to PXL16.

The image displayed in the first, third, sixth, eighth, ninth, eleventh, fourteenth and sixteenth pixel units PXL1, PXL3, PXL6, PXL8, PXL9, PXL11, PXL14 and PXL16 is different from the image displayed in the second, fourth, fifth, seventh, tenth, twelfth, thirteenth and fifteenth pixel units PXL2, PXL4, PXL5, PXL7, PXL10, PXL12, PXL13 and PXL15. For example, the first, third, sixth, eighth, ninth, eleventh, fourteenth and sixteenth pixel units PXL1, PXL3, PXL6, PXL8, PXL9, PXL11, PXL14 and PXL16 display the white; and the second, fourth, fifth, seventh, tenth, twelfth, thirteenth and fifteenth pixel units PXL2, PXL4, PXL5, PXL7, PXL10, PXL12, PXL13 and PXL15 display the black.

An order of driving the pixel cells connected to the data lines DL1 to DLm is explained as follows.

Among the four pixel cells included in the adjacent '4d+1'th and '4d+2'th pixel rows ('d' is a positive whole number including '0') and connected to the odd-numbered data line in common, the pixel cell included in the '4d+1'th pixel row and positioned at the left side of the odd-numbered data line is driven firstly; the pixel cell included in the '4d+2'th pixel row and positioned at the left side of the odd-numbered data line is driven secondly; the pixel cell included in the '4d+1'th pixel row and connected to the right side of the odd-numbered data line is driven thirdly; and the pixel cell included in the '4d+2'th pixel row and connected to the odd-numbered data line is driven finally.

For example, the red and green pixel cells R, G included in the first pixel unit PXL1 and the red and green pixel cells R, G included in the fifth pixel unit PXL5 are connected to the first data line DL1 in common. Among the above-mentioned four pixel cells, the red pixel cell R included in the first pixel unit PXL1 is driven firstly; the red pixel cell R included in the fifth pixel unit PXL5 is driven secondly; the green pixel cell G included in the first pixel unit PXL1 is driven thirdly; and the green pixel cell G included in the fifth pixel unit PXL5 is driven finally.

Among the four pixel cells included in the adjacent '4d+1'th and '4d+2'th pixel rows ('d', is a positive whole number including '0') and connected to the even-numbered data line in common, the pixel cell included in the '4d+1'th pixel row and positioned at the right side of the even-numbered data line is driven firstly; the pixel cell included in the '4d+2'th pixel row and positioned at the right side of the even-numbered data line is driven secondly; the pixel cell included in the '4d+1'th pixel row and positioned at the left side of the even-numbered data line is driven thirdly; and the pixel cell included in the '4d+2'th pixel row and positioned at the left side of the even-numbered data line is driven finally.

For example, the red and green pixel cells R, G included in the third pixel unit PXL3 and the red and green pixel cells R, G included in the seventh pixel unit PXL7 are connected to the fourth data line DL4 in common. Among the above-mentioned four pixel cells, the green pixel cell G included in the third pixel unit PXL3 is driven firstly; the green pixel cell G included in the seventh pixel unit is driven secondly; the red pixel cell R included in the third pixel unit PXL3 is driven thirdly; and the red pixel cell R included in the seventh pixel unit PXL7 is driven finally.

Among the four pixel cells included in the adjacent '4d+3'th and '4d+4'th pixel rows and connected to the odd-numbered data line in common, the pixel cell included in the '4d+3'th pixel row and positioned at the right side of the odd-numbered data line is driven firstly; the pixel cell included in the '4d+4'th pixel row and positioned at the right side of the odd-numbered data line is driven secondly; the pixel cell included in the '4d+3'th pixel row and positioned at the left side of the odd-numbered data line is driven thirdly; and the pixel cell included in the '4d+4'th pixel row and positioned at the left side of the odd-numbered data line is driven finally.

For example, the red R and green G pixel cells included in the ninth pixel unit PXL9 and the red R and green G pixel cells included in the thirteenth pixel unit PXL13 are connected to the first data line DL1 in common. Among the above-mentioned four pixel cells, the green pixel cell G included in the ninth pixel unit PXL9 is driven firstly; the green pixel cell G included in the thirteenth pixel unit PXL13 is driven secondly; the red pixel cell R included in the ninth pixel unit PXL9 is driven thirdly; and the red pixel cell R included in the thirteenth pixel unit PXL13 is driven finally.

Among the four pixel cells included in the adjacent '4d+3'th and '4d+4'th pixel rows and connected to the even-numbered data line, the pixel cell included in the '4d+3'th pixel row and positioned at the left side of the even-numbered data line is driven firstly; the pixel cell included in the '4d+4'th pixel row and positioned at the left side of the even-numbered data line is driven secondly; the pixel cell included in the '4d+3'th pixel row and positioned at the right side of the even-numbered data line is driven thirdly; and the pixel cell included in the '4d+4'th pixel row and positioned at the right side of the even-numbered data line is driven finally.

For example, the red R and green G pixel cells included in the eleventh pixel unit PXL11, and the red R and green G pixel cells included in the fifteenth pixel unit PXL15 are connected to the fourth data line DL4 in common. Among the above-mentioned four pixel cells, the red pixel cell R included in the eleventh pixel unit PXL11 is driven firstly; the red pixel cell R included in the fifteenth pixel unit PXL5 is driven secondly; the green pixel cell G included in the eleventh pixel unit PXL11 is driven thirdly; and the green pixel cell G included in the fifteenth pixel unit PXL15 is driven finally.

Accordingly, the green pixel cell G included in the pixel unit of displaying the white is driven after driving the red pixel cell R included in the pixel unit of displaying the black. In other words, the green pixel cell G included in the pixel unit of displaying the white is supplied with the data from the data line for a predetermined period after a period of supplying the data to the red pixel cell R included in the pixel unit of displaying the black.

For example, the green pixel cell G included in the ninth pixel unit PXL9 of displaying the white is driven after driving the green pixel cell G included in the fifth pixel unit PXL5 of displaying the black. In other words, the green pixel cell G included in the ninth pixel unit PXL9 is supplied with the data from the first data line DL1 for the predetermined period after the period of supplying the data to the green pixel cell G included in the fifth pixel unit PXL5.

The gate lines GL1 to GL8 are driven in sequence by the scan pulses Vout1 to Vout8 from the gate driver GD.

Among the '8a+1'th gate line to the '8a+8'th gate line, they are driven in a sequential order from the '8a+1'th gate line, the '8a+3'th gate line, the 8a+2'th gate line, the '8a+4'th gate line, the '8a+6'th gate line, the '8a+8'th gate line, the '8a+5'th gate line, and the '8a+7'th gate line. For example, among the first to eighth gate lines GL1 to GL8, they are driven in a sequential order from the first gate line GL1, the third gate line GL3, the second gate line GL2, the fourth gate line GL4, the sixth gate line GL6, the eighth gate line GL8, the fifth gate line GL5, and the seventh gate line GL7.

As shown in (a) of FIG. 6, the scan pulses Vout1 to Vout8 may be output in sequence. Also, as shown in FIG. (b) of FIG. 6, the scan pulses Vout1 to Vout8 may be overlapped at their high periods, and outputted with the overlapped periods.

In the liquid crystal display device having the structure of FIG. 5, the polarity of data signal supplied to one data line is inverted every two periods, as shown in FIG. 6.

The green pixel cell G included in the pixel unit PXL of displaying the white is driven after the predetermined pixel cell included in the pixel unit PXL of displaying the black. In other words, the green pixel cell G is supplied with the corresponding data under condition of that the data line connected to the corresponding green pixel cell G is charged with the data corresponding to the pixel cell included in the pixel unit of displaying the black. The green pixel cells G included in all pixel units PXL of displaying the white are supplied with the corresponding data under the aforementioned conditions. Thus, the liquid crystal display device according to the present invention can prevent the difference of luminance among the green pixel cells G, thereby preventing the deterioration of picture quality in the super pixel gray pattern.

As mentioned above, the liquid crystal display device according to the present invention and the method of driving the same have the following advantages.

In the liquid crystal display device according to the present invention according to the present invention, the green pixel cell included in the pixel unit of displaying the white is driven after driving the predetermined pixel cell included in the pixel unit of displaying the black.

In other words, the green pixel cell G is supplied with the corresponding data under condition of that the data line connected to the corresponding green pixel cell G is charged with the data corresponding to the pixel cell included in the pixel unit of displaying the black.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device with shared data lines, comprising:

a liquid crystal panel including a plurality of pixel units arranged in a matrix configuration;

red, green and blue pixel cells provided in the pixel units respectively;

a data driver to supply data to pixel cells included in each pixel unit, so as to realize adjacent pixel units displayed with black and white; and a gate driver to drive the pixel cells included in each pixel unit, so as to make the green pixel cell in the pixel unit of displaying the white supplied with corresponding data such that a data line connected to the corresponding green pixel cell is previously charged with data corresponding to the pixel cell included in the pixel unit of displaying the black, wherein a second pixel unit positioned right above a first pixel unit, a third pixel unit positioned right under the first pixel unit, a fourth pixel unit positioned directly right to the first pixel unit, and a fifth pixel unit positioned directly left to the first pixel unit display one of the white and the black such that the second to fifth pixel units display the same color, wherein a color displayed on the first pixel unit differs from the colors displayed on the second to fifth pixel unit, wherein the liquid crystal panel comprises:

a plurality of pixel rows provided with the red, green and blue pixel cells;

an upper gate line positioned at an upper side of each pixel row and connected to the gate driver; and a lower gate line positioned at a lower side of each pixel row and connected to the gate driver, wherein the upper gate line is connected to the '12c+1'th pixel cell ('c' is a positive number including '0'), the '12c+4'th pixel cell, the '12c+5'th pixel cell, the '12c+8'th pixel cell, the '12c+9'th pixel cell and the '12c+12' pixel cell in common, and the lower gate line is connected to the '12c+2'th pixel cell, the '12c+3'th pixel cell, the '12c+6'th pixel cell, the '12c+7'th pixel cell, the '12c+10'th pixel cell and the '12c+11'th pixel cell among the pixel cells arranged in each pixel row, wherein the '2c−1'th pixel cell and the '2c'th pixel cell among the pixel cells arranged in each pixel row are connected to one data line in common, wherein the '12c+1'th pixel cell, the '12c+4'th pixel cell, the '12c+7'th pixel cell and the '12c+10'th pixel cell correspond to the red pixel cells; the '12c+2'th pixel cell, the '12c+5'th pixel cell, the '12c+8'th pixel cell and the '12c+11'th pixel cell correspond to the green pixel cells; and the '12c+3'th pixel cell, the '12c+6'th pixel cell, the '12c+9'th pixel cell and the '12c+12'th pixel cell correspond to the blue pixel cells, and wherein the gate driver firstly supplies the scan pulse to the upper gate line of the first pixel row; secondly supplies the scan pulse to the upper gate line of the second pixel thirdly supplies the scan pulse to the lower gate line of the first pixel row; fourthly supplies the scan pulse to the lower gate line of the second pixel row; fifthly supplies the scan pulse to the upper gate line of the third pixel row; sixthly supplies the scan pulse to the upper gate line of the fourth pixel row; seventhly supplies the scan pulse to the lower gate line of the third pixel row; and eighthly supplies the scan pulse to the lower gate line of the fourth pixel row, so as to drive the red, green and blue pixel cells included in the adjacent first to fourth pixel rows.

2. The liquid crystal display device of claim 1, wherein the scan pulses outputted for the adjacent periods are overlapped at their high periods.

3. A liquid crystal display device with shared data lines, comprising:

a liquid crystal panel including a plurality of pixel units arranged in a matrix configuration;

red, green and blue pixel cells provided in the pixel units respectively;

a data driver to supply data to pixel cells included in each pixel unit, so as to realize adjacent pixel units displayed with black and white; and a gate driver to drive the pixel cells included in each pixel unit, so as to make the green pixel cell in the pixel unit of displaying the white supplied with corresponding data such that a data line connected to the corresponding green pixel cell is previously charged with data corresponding to the pixel cell included in the pixel unit of displaying the black, wherein a second pixel unit positioned right above a first pixel unit, a third pixel unit positioned right under the first pixel unit, a fourth pixel unit positioned directly right to the first pixel unit, and a fifth pixel unit positioned directly left to the first pixel unit display one of the white and the black such that the second to fifth pixel units display the same color, wherein a color displayed on the first pixel unit differs from the colors displayed on the second to fifth pixel unit, wherein the liquid crystal panel comprises:

a plurality of pixel rows provided with the red, green and blue pixel cells;

an upper gate line positioned at an upper side of each pixel row and connected to the gate driver; and a lower gate line positioned at a lower side of each pixel row and connected to the gate driver, wherein the upper gate line is connected to the '12c+1'th pixel cell ('c' is a positive number including '0'), the '12c+4'th pixel cell, the '12c+5'th pixel cell, the '12c+8'th pixel cell, the '12c+9'th pixel cell and the '12c+12' pixel cell in common, and the lower gate line is connected to the '12c+2'th pixel cell, the '12c+3'th pixel cell, the '12c+6'th pixel cell, the '12c+7'th pixel cell, the '12c+10'th pixel cell and the '12c+11'th pixel cell among the pixel cells arranged in each pixel row, wherein the '2c−1'th pixel cell and the '2c'th pixel cell among the pixel cells arranged in each pixel row are connected to one data line in common, wherein the '12c+1'th pixel cell, the '12c+4'th pixel cell, the '12c+7'th pixel cell and the '12c+10'th pixel cell correspond to the red pixel cells; the '12c+2'th pixel cell, the '12c+5'th pixel cell, the '12c+8'th pixel cell and the '12c+11'th pixel cell correspond to the green pixel cells; and the '12c+3'th pixel cell, the '12c+6'th pixel cell, the '12c+9'th pixel cell and the '12c+12'th pixel cell correspond to the blue pixel cells, and wherein the gate driver firstly supplies the scan pulse to the upper gate line of the first pixel row; secondly supplies the scan pulse to the upper gate line of the second pixel row; thirdly supplies the scan pulse to the lower gate line of the first pixel row; fourthly supplies the scan pulse to the lower gate line of the second pixel row; fifthly supplies the scan pulse to the lower gate line of the third pixel row; sixthly supplies the scan pulse to the lower gate line of the fourth pixel row; seventhly supplies the scan pulse to the upper gate line of the third pixel row; and eighthly supplies the scan pulse to the upper gate line of the fourth pixel row.

4. A method for previously charging green pixel cells of liquid crystal display device provided with a liquid crystal panel including a plurality of pixel units arranged in a matrix configuration, and red, green and blue pixel cells provided in the pixel units respectively, the method comprising:

A step of supplying data to the pixel cells included in each pixel unit, so as to realize adjacent pixel units displayed with black and white; and B step of driving the pixel cells included in each pixel unit, so as to make the green pixel cell in the pixel unit of displaying the white supplied with corresponding data such that a data line connected to the corresponding green pixel cell is previously charged with data corresponding to the pixel cell included in the pixel unit of displaying the black, wherein a second pixel unit positioned right above a first pixel unit, a third pixel unit positioned right under the first pixel unit, a fourth pixel unit positioned directly right to the first pixel unit, and a fifth pixel unit positioned directly left to the first pixel unit display one of the white and the black such that the second to fifth pixel units display the same color, wherein a color displayed on the first pixel unit differs from the colors displayed on the second to fifth pixel unit, wherein the liquid crystal panel comprises:

a plurality of pixel rows provided with the red, green and blue pixel cells;

an upper gate line positioned at an upper side of each pixel row and connected to the gate driver; and a lower gate line positioned at a lower side of each pixel row and connected to the gate driver, wherein the upper gate line is connected to the '12c+1'th pixel cell ('c' is a positive number including '0'), the '12c+4'th pixel cell, the '12c+5'th pixel cell, the '12c+8'th pixel cell, the '12c+9'th pixel cell and the '12c+12' pixel cell in common, and the lower gate line is connected to the '12c+2'th pixel cell, the '12c+3'th pixel cell, the '12c+6'th pixel cell, the '12c+7'th pixel cell, the '12c+10'th pixel cell and the '12c+11'th pixel cell among the pixel cells arranged in each pixel row, wherein the '2c−1'th pixel cell and the '2c'th pixel cell among the pixel cells arranged in each pixel row are connected to one data line in common, wherein the '12c+1'th pixel cell, the '12c+4'th pixel cell, the '12c+7'th pixel cell and the '12c+10'th pixel cell correspond to the red pixel cells; the '12c+2'th pixel cell, the '12c+5'th pixel cell, the '12c+8'th pixel cell and the '12c+11'th pixel cell correspond to the green pixel cells; and the '12c+3'th pixel cell, the '12c+6'th pixel cell, the '12c+9'th pixel cell and the '12c+12'th pixel cell correspond to the blue pixel cells, and wherein the B step includes:

B-1 step of firstly supplying the scan pulse to the upper gate line of the first pixel row; B-2 step of secondly supplying the scan pulse to the upper gate line of the second pixel row; B-3 step of thirdly supplying the scan pulse to the lower gate line of the first pixel row; B-4 step of fourthly supplying the scan pulse to the lower gate line of the second pixel row; B-5 step of fifthly supplying the scan pulse to the upper gate line of the third pixel row; B-6 step of sixthly supplying the scan pulse to the upper gate line of the fourth pixel row; B-7 step of seventhly supplying the scan pulse to the lower gate line of the third pixel row; and B-8 step of eighthly supplying the scan pulse to the lower gate line of the fourth pixel row, so as to drive the red, green and blue pixel cells included in the adjacent first to fourth pixel rows.

* * * * *

UNITED STATES PATENT AND TRADEMARK OFFICE

CERTIFICATE OF CORRECTION

PATENT NO. : 8,378,952 B2
APPLICATION NO. : 11/966839
DATED : February 19, 2013
INVENTOR(S) : Kim It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1115 days.

Signed and Sealed this
Thirtieth Day of December, 2014

Michelle K. Lee

Michelle K. Lee
*Deputy Director of the United States Patent and Trademark Office*